US010508415B2

(12) United States Patent
Kim

(10) Patent No.: US 10,508,415 B2
(45) Date of Patent: Dec. 17, 2019

(54) SWING CONTROL APPARATUS OF CONSTRUCTION EQUIPMENT AND CONTROL METHOD THEREOF

(71) Applicant: VOLVO CONSTRUCTION EQUIPMENT AB, Eskilstuna (SE)

(72) Inventor: Ji-Yun Kim, Gyeongsangnam-do (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 163 days.

(21) Appl. No.: 15/539,075

(22) PCT Filed: Dec. 24, 2014

(86) PCT No.: PCT/KR2014/012834
§ 371 (c)(1),
(2) Date: Jun. 22, 2017

(87) PCT Pub. No.: WO2016/104832
PCT Pub. Date: Jun. 30, 2016

(65) Prior Publication Data

US 2017/0342683 A1 Nov. 30, 2017

(51) Int. Cl.
*E02F 9/12* (2006.01)
*E02F 3/32* (2006.01)
(Continued)

(52) U.S. Cl.
CPC ..... *E02F 9/123* (2013.01); *E02F 3/32* (2013.01); *E02F 3/425* (2013.01); *E02F 9/2004* (2013.01);
(Continued)

(58) Field of Classification Search
CPC ... E02F 9/123; E02F 3/32; E02F 3/425; E02F 9/128; E02F 9/2004; E02F 9/2228;
(Continued)

(56) References Cited

U.S. PATENT DOCUMENTS 5,941,155 A * 8/1999 Arai ..... E02F 9/123 91/38
5,950,430 A * 9/1999 Tohji ..... E02F 9/123 60/426
(Continued)

FOREIGN PATENT DOCUMENTS

JP H09177135 A 7/1997
JP H09256407 A 9/1997
(Continued)

OTHER PUBLICATIONS

Haraoka et al., JP H11-036376, Feb. 9, 1999 (machine translation).*
(Continued)

*Primary Examiner* — Courtney D Heinle
(74) *Attorney, Agent, or Firm* — Sage Patent Group

(57) ABSTRACT

A pivot control apparatus of construction equipment is provided for reaching a desired swing angle by controlling the brake torque of a swing motor during a loading operation using an excavator, along with a control method therefor. The swing control apparatus of construction equipment according to one embodiment of the present invention includes first and second hydraulic pumps and a pilot pump; a boom cylinder, an arm cylinder, and a bucket cylinder which are driven by the hydraulic fluid of the first and second hydraulic pumps; an operation apparatus control valve for controlling the hydraulic fluid which is supplied from the first and second hydraulic pumps to the boom cylinder, the arm cylinder and the bucket cylinder; a swing motor Which is driven by the hydraulic fluid of any one of the first and second hydraulic pumps to swing an upper swinging, body; a swing control valve; a swing operation lever, a direction control valve which applies a pilot pressure to the swing control valve according to the swing operation lever or a semi-automatic swing mode selection; electronic proportional variable relief valves capable of variably
(Continued)

adjusting the relief setup pressure of the swing motor; and a controller which, when a semi-automatic swing mode is selected and the operation apparatus is actuated at the time of swing return, applies an electric signal to the variable relief valve at the outlet side, from among the electronic proportional variable relief valves, so as to increase or decrease the relief setup pressure.

4 Claims, 3 Drawing Sheets

(51) Int. Cl.
*E02F 3/42* (2006.01)
*E02F 9/20* (2006.01)
*E02F 9/22* (2006.01)

(52) U.S. Cl.
CPC ..... *E02F 9/2228* (2013.01); *E02F 9/2267* (2013.01); *E02F 9/2285* (2013.01); *E02F 9/2292* (2013.01)

(58) Field of Classification Search
CPC ..... E02F 9/2235; E02F 9/2267; E02F 9/2285; E02F 9/2292; E02F 9/2296
See application file for complete search history.

(56) References Cited

U.S. PATENT DOCUMENTS

2007/0219693 A1* 9/2007 Stratton ..... E02F 3/844 701/50
2011/0020146 A1* 1/2011 Akiyama ..... E02F 9/123 417/213
2012/0131913 A1* 5/2012 Yoshino ..... E02F 9/2235 60/459
2016/0002887 A1* 1/2016 Izumi ..... H02P 6/08 701/50
2018/0347151 A1* 12/2018 Tsukamoto ..... E02F 9/123

FOREIGN PATENT DOCUMENTS

JP H1136376 A 2/1999
JP H1137108 A 2/1999
JP 2000328603 A 11/2000

OTHER PUBLICATIONS

International Search Report (dated Jun. 26, 2015) for corresponding International App. PCT/KR2014/012834.

* cited by examiner

[Fig. 1]
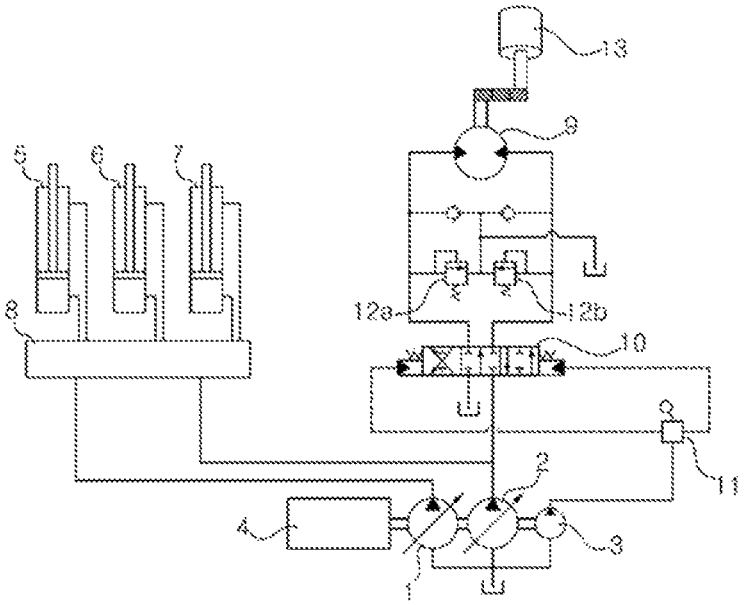
[Fig. 2]
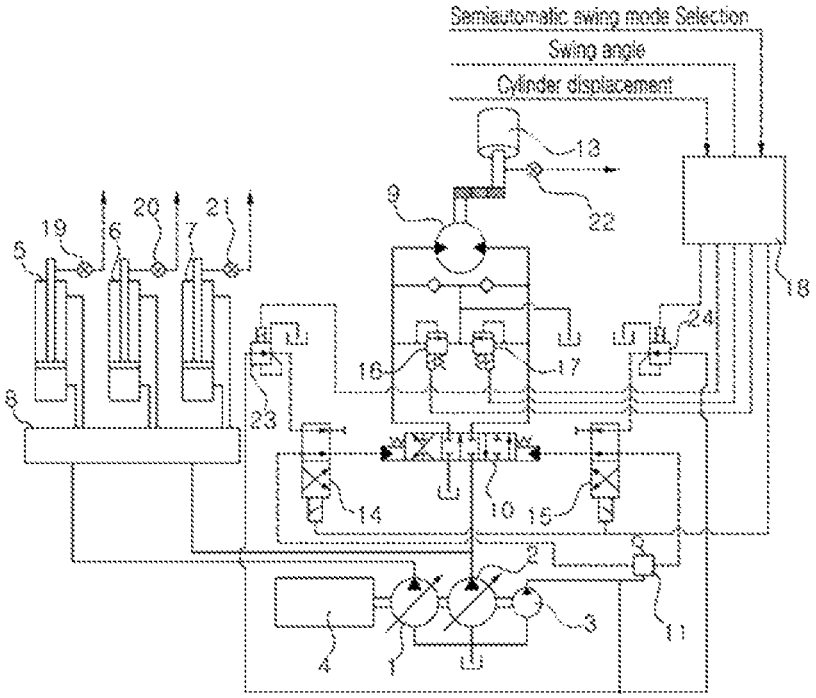

[Fig. 3]
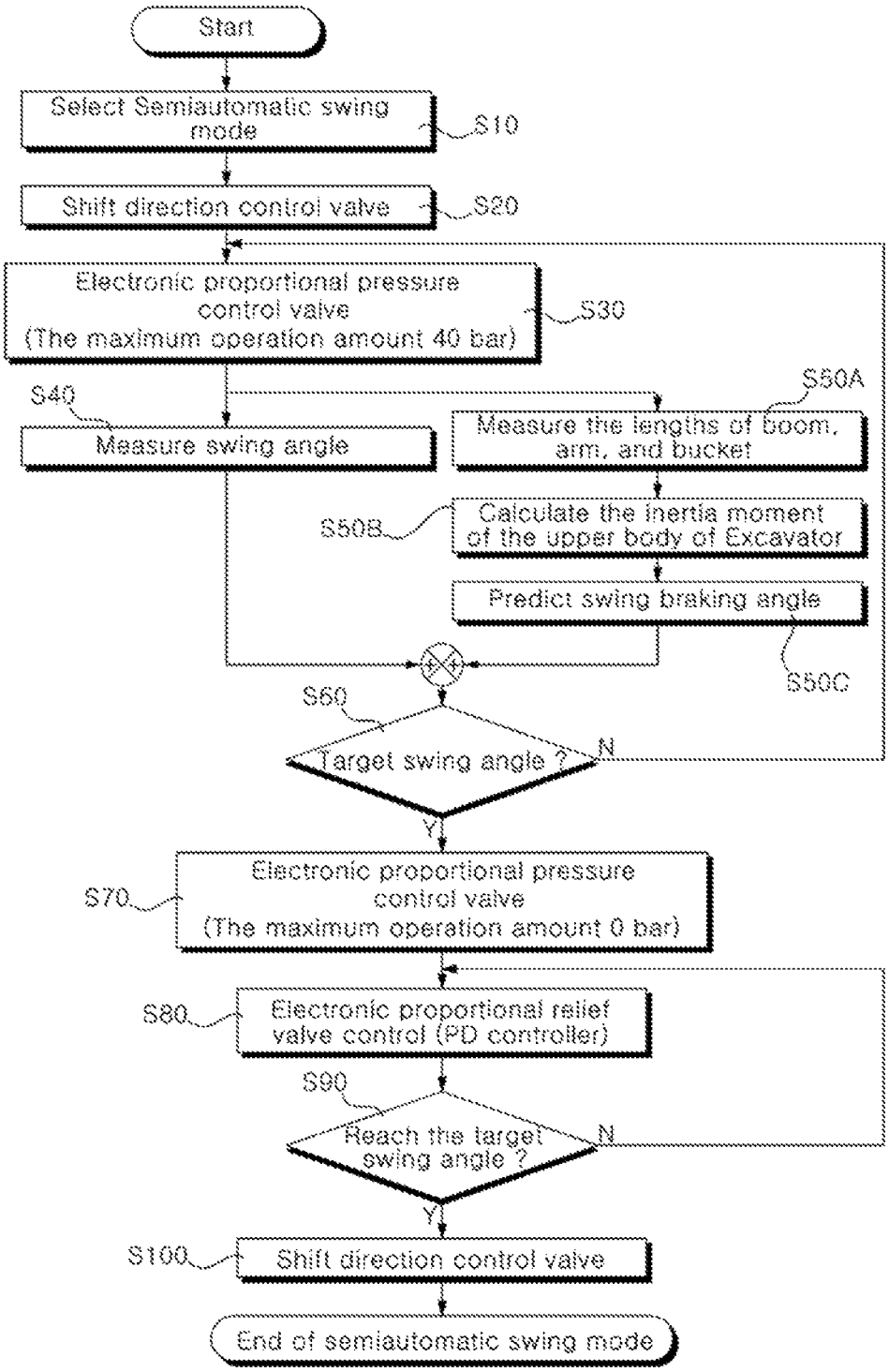

[Fig. 4]
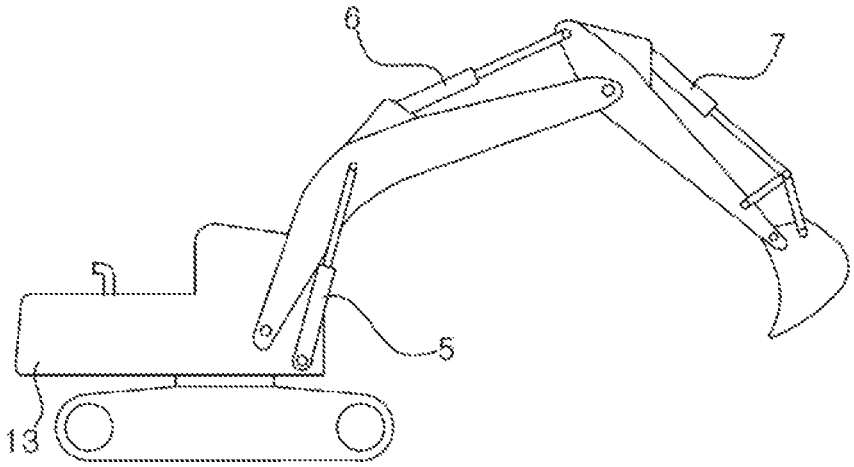
[Fig. 5]
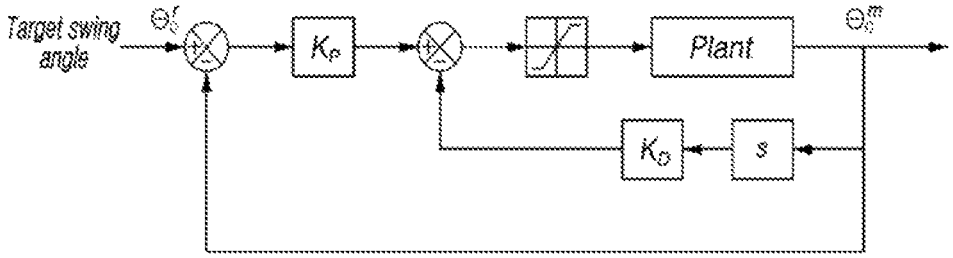

SWING CONTROL APPARATUS OF CONSTRUCTION EQUIPMENT AND CONTROL METHOD THEREOF

BACKGROUND AND SUMMARY

The present invention relates to a swing control apparatus of construction equipment and control method thereof, and more particularly, a swing control apparatus and method for construction equipment, in which the machine is capable of making a swing angle reach a target angle by controlling a braking torque of a swing motor during the loading operation of an excavator.

In general, excavators are well known in the an and for use in a loading operation work. The loading operation work may include a scooping excavation of scooping up the earth and sand using a bucket, a swing operation of swinging or revolving an upper swing body, a dumping operation of loading the earth and sand to the dump truck and a return swing operation of returning the upper swing body to a position associated with the scooping excavation.

FIG. 1 is a hydraulic circuit diagram of a swing control apparatus of construction equipment according to the conventional technology.

In FIG. 1, first and second variable displacement hydraulic pumps (hereinafter, the first and second hydraulic pumps) (1, 2) and a pilot pump (3) are connected to an engine (4).

Boom cylinder (5), arm cylinder (6) and bucket cylinder (7) which drive the boom, arm, and bucket by hydraulic fluid supplied from the first and second hydraulic pumps (1, 2) are connected to the first and second hydraulic pumps (1, 2).

A control valve of the work device (MCV) (8) for controlling the supply of the hydraulic fluid from the first and second hydraulic pumps (1, 2) is installed in flow paths of the first and second hydraulic pumps (1, 2).

The second hydraulic pump (2) is connected to a swing motor (9) for swinging the or revelving the upper swing body (13) which is driven by hydraulic fluid supplied from the second hydraulic pump (2).

A swing control valve (MCV) (10) is installed in a flow path between the second hydraulic pump (2) and the swing motor (9). A swing operation lever (11) (RCV) for applying a pilot pressure in order to shift the swing control valve (10) is installed in a path between the pilot pump (3) and the swing control valve (10).

Inside the swing motor (9) are installed relief valves (12*a*, 12*b*) for controlling a swing braking torque of the swing motor (9).

The relief pressures of the relief valves (12*a*, 12*b*) are preset and given by a spring force of the valve spring. Thus, the maximum torque of the swing motor (9) is limited by the preset relief pressure of the relief valve (12*a*, 12*b*) That is, the torque is limited up to the maximum based on the preset relief pressure of the relief valve (12*a*, 12*b*) when the swing motor (9) is accelerated or decelerated to the maximum level.

Moreover, when the work devices such as boom, arm and bucket are operated during a swing operation of the upper swing body, the inertia moment of rotation of the upper swing body varies, making it more difficult to control a swing angle so that it reaches a target angle.

It is desirable to provide a swing control apparatus for construction equipment and a method thereof for making a swing angle reach a target angle even when the inertia moment of an upper swing body is varied as the work devices are operated on a return swing in the process of the loading operation of the excavator.

In accordance with an aspect of the present invention, there, is provided a swing control apparatus for construction equipment comprising:

first and second hydraulic pumps and the pilot pump;

a work devices including a boom, an arm and a bucket which are operated by a boom cylinder, an arm cylinder and a bucket cylinder driven by hydraulic fluid of the first and second hydraulic pumps;

a work device control valve for controlling hydraulic fluid supplied from the first and second hydraulic pumps;

a swing motor for swinging an upper swing body which is driven by hydraulic fluid supplied from one of the first and second hydraulic pumps;

a swing control valve for controlling hydraulic fluid supplied to the swing motor from the first or second hydraulic pump;

a swing operation lever;

a direction control valve for applying to the swing control valve a pilot pressure supplied by operating the swing operation lever, or a pilot pressure supplied by selecting a semiautomatic swing mode;

at least one electronic proportional variable relief valve installed in the swing motor, which variably controls a preset relief pressure so as to vary a braking torque of the swing motor; and a controller for applying an electric control signal to the electronic proportional variable relief valve to be relieved so that the relief pressure of the electronic proportional variable relief valve is preset to increase or decrease in order to make a target swing angle become the sum of a swing braking angle predicted from the inertia moment of the upper swing body plus a swing angle detected of the upper swing body, when the semiautomatic mode is selected and the work device is operated during a return swing of the upper swing body.

According to an embodiment of the present invention, there is provided a swing control method for construction equipment, including first and second hydraulic pumps and a pilot pump;

a work device including a boom, an arm and a bucket, which are operated by a boom cylinder, an arm cylinder and a bucket cylinder, respectively, driven by the hydraulic fluid of the first and second hydraulic pumps;

a work device control valve which is configured to control hydraulic fluid supplied from the first and second hydraulic pumps to the boom cylinder, arm cylinder and bucket cylinder, respectively;

a swing motor for swinging an upper swing body which is driven by the hydraulic fluid supplied from one of the first and second hydraulic pumps;

a swing control valve for controlling the hydraulic fluid supplied to the swing motor from the first or second hydraulic pump;

a swing operation lever;

a direction control valve for applying to the swing control valve a pilot pressure supplied by operating the swing operation lever, or a pilot pressure supplied by selecting a semiautomatic swing mode;

an electronic proportional pressure control valve for applying the hydraulic fluid from the pilot pump to the swing control valve through the direction control valve, if the semiautomatic swing mode is selected;

an electronic proportional variable relief valve which variably controls a preset relief pressure so as to vary a braking torque of the swing motor;

a swing angle sensor for detecting a swing angle of the upper swing body;

displacement sensors for detecting the displacements of the boom, arm, and bucket, respectively, during a return swing of the upper swing body; and a controller for applying an electric control signal and adjusting the preset relief pressure of the electronic proportional variable relief valve by the electric control signal during a return swing of the upper swing body, the method comprising:

a step of selecting the semiautomatic swing mode;

a step of shifting the direction control valve so that the pilot pressure regulated by the electronic proportional pressure control valve is applied to the swing control valve, if the semiautomatic swing mode is selected;

a step of determining whether or not the sum of a predicted swing braking angle plus the swing angle detected of the upper swing body is equal to a target swing angle;

a step of shifting to a neutral state of the swing control valve by blocking the pilot pressure applied to the swing control valve, if the sum of the predicted swing braking angle plus the swing angle detected of the upper swing body is equal to the target swing angle;

a step of determining whether the swing angle of the upper swing body reaches the target swing angle; and a step of shifting the direction control valve so that a pilot pressure by operating of the swing operation lever is applied to the swing control valve, if the swing angle of the upper swing body reaches the target swing angle.

The swing control apparatus further comprises an electronic proportional pressure control valve which is configured to apply a pilot pressure to the swing control valve, wherein the pilot pressure from the pilot pump is adjusted by convening an electrical current value that corresponds a maximum operation amount of the swing operation lever, if the semiautomatic swing mode is selected.

The swing operation lever includes a selection switch for selecting the semiautomatic swing mode which turns off when the swing operation lever is operated during the return swing of the upper swing body. The controller includes a PD controller for applying a calculated electrical current value to the electronic proportional variable relief valve to be relieved, in which the PD controller is performed with the target swing angle of PD control inputted by the sum of the swing braking angle predicted from the inertia moment of the upper swing body plus the swing angle detected of the upper swing body so that the target swing angle can be reached by compensating the inertia moment of the upper swing body, which varies when the work device is operated during the return swing of the upper swing body.

The swing control apparatus further comprises displacement sensors for detecting the displacements of the boom, arm, and bucket during the return swing of the upper swing body, and a swing angle sensor for detecting the swing angle of the upper swing body and outputting the detected swing signal to the controller The method further comprises a step of applying the electrical signal to the electronic proportional variable relief valve to be relieved so that the relief pressure of the electronic proportional variable relief valve is preset to increase or decrease in order to control the target swing angle to be the sum of the swing braking angle predicted from the inertia moment of the upper swing body plus the swing angle detected of the upper swing body, when the work device is operated during the return swing of the upper swing body. The swing braking angle of the upper swing body is predicted from the inertia moment of the upper swing body which is calculated by the angles of the boom, arm and bucket detected by displacement sensors of the boom, arm, and bucket during the return swing of the upper swing body.

The method further comprises a step of proceeding to step of shifting the direction control valve so that the pilot pressure regulated by the electronic proportional pressure control valve is applied to the swing control valve, if the sum of the detected swing angle of the upper swing body plus the predicted swing braking angle is not equal to the target swing angle.

The method further comprises a step of proceeding to step of applying the electrical signal so that the relief pressure of the electronic proportional variable relief valve is preset to increase or decrease, if the swing angle of the upper swing body does not reach the target swing angle.

According to the embodiment of the present invention having the above-described configuration, a target swing angle can be reached by controlling a braking torque by varying a preset relief pressure of an electronic proportional variable relief valve, even when the inertia moment of an upper swing body is varied as the work device is operated in the process of the return swing of the upper swing body during the loading operation.

BRIEF DESCRIPTION OF THE DRAWINGS

The above features and advantages of the present invention will become more apparent by describing the preferred embodiments thereof with reference to the accompanying drawings, in which:

FIG. 1 is a hydraulic circuit diagram of a swing control apparatus according to the conventional technology.

FIG. 2 is a hydraulic circuit diagram of a swing control apparatus for construction equipment according to an embodiment of the present invention.

FIG. 3 is a flow chart of the swing control method for construction equipment according to an embodiment of the present invention.

FIG. 4 is a side view of an excavator illustrating a swing control apparatus for construction equipment according to an embodiment of the present invention.

FIG. 5 is a schematic view of a PD controller for controlling an electronic proportional variable relief valve according to the swing control method for construction equipment according to an embodiment of the present invention.

Explanation of reference numerals for main parts in the drawing

1; first hydraulic pump
2; second hydraulic pump
3; pilot pump
4; engine
5; boom cylinder
6; arm cylinder
7; bucket cylinder
8; work device control valve
9; swing motor
10; swing control valve
11; swing operation lever
13; upper swing body
14, 15; direction control valve
16, 17; electronic proportional variable relief valve
18; controller
19, 20, 21; displacement sensor 22; swing angle sensor 23, 24; electronic proportional pressure control valve

DETAILED DESCRIPTION

Hereinafter, the semiautomatic swing control apparatus and the control method thereof according to a preferred embodiment of the present invention will be described in detail with reference to the accompanying drawings.

FIG. 2 is a hydraulic circuit diagram of a swing control apparatus for construction equipment according to an embodiment of the present invention. FIG. 3 is a flow chart of a swing control method for construction equipment according to an embodiment of the present invention. FIG. 4 is a side view of the excavator illustrating the swing control apparatus of the construction equipment according to an embodiment of the present invention. FIG. 5 is a schematic view of a PD controller for controlling an electronic proportional variable relief valve according to the swing control method of the construction equipment according to an embodiment of the present invention.

Referring to FIGS. 2, 4 and 5, first and second variable displacement hydraulic pumps (hereinafter, the first and second hydraulic pumps)(1, 2) and a pilot pump (3) are connected to an engine (4).

A boom cylinder (5), an arm cylinder (6) and a bucket cylinder (7) which drive a boom, an arm, and a bucket, respectively, by hydraulic fluid supplied from the first and second hydraulic pumps (1, 2) are connected to the first and second hydraulic pumps (1, 2).

A work device control valve (8) for controlling hydraulic fluid supplied from the first and second hydraulic pumps (1, 2) is installed in a flow path of the first and second hydraulic pumps (1, 2).

The second hydraulic pump (2) is connected to a swing motor (9) for swinging, an upper swing body (13) which is driven by hydraulic fluid supplied from the second hydraulic pump (2).

A swing control valve (10) is installed in a flow path between the second hydraulic pump (2) and a swing motor (9). A swing operation lever (11) (RCV) for applying a pilot pressure in order to shift the swing control valve (10) is installed in a flow path between the pilot pump (3) and the swing control valve (10).

In a flow path between the swing operation lever (11) and the swing control valve (10) are installed direction control valves (14, 15) for applying to the swing control valve (10) a pilot pressure supplied by operating the swing operation lever (11), or a pilot pressure supplied by selecting a semiautomatic swing mode Inside the swing motor (9) are installed electronic proportional variable relief valves (16, 17) for variably controlling a preset relief pressures so as to adjust a swing braking torque of the swing motor (9).

Within the boom cylinder (5), arm cylinder (6) and the bucket cylinder (7) are installed displacement sensors (19, 20, 21) for detecting the displacements of the boom, arm, and bucket, respectively, and outputting the detected signals to the controller (18) so that the respective angles of boom, arm, and bucket during a return swing of the upper swing body (13) can be calculated.

A swing angle sensor (22) is installed in the upper swing body (13) for detecting a swing angle of the upper swing body and outputting the detected swing angle signal to a controller (18)

Electronic proportional pressure control valves (23, 24) are respectively installed in the flow path between the pilot pump (3) and the direction control valve (14, 15), which apply the pilot pressure to the swing control valve (10), if the semiautomatic swing mode is selected. The pilot pressure is given by converting the hydraulic fluid from the pilot pump (3) to an electrical current value corresponding to a maximum operation amount of the swing operation lever (11).

The controller (18) is connected to the direction control valve (14, 15), the electronic proportional variable relief valve (16, 17) and the electronic proportional pressure control valve (23, 24), which applies an electric control signal so that the relief pressure of the electronic proportional variable relief valve (16, 17) to be relieved is preset to increase or decrease in order to make a target swing angle become the sum of a swing braking angle predicted from the inertia moment of the upper swing body (13) plus the detected swing angle of the upper swing body (13), if the semiautomatic mode is selected and the work device is operated during the return swing of the upper swing body (13).

The swing operation lever (11) is provided with the selection switch (not shown in figure) for selecting the semiautomatic swing mode which turns off when the swing operation lever is operated during the return swing of the upper swing body. The controller (18) may employ a PD controller for applying the calculated electrical current value to the electronic proportional variable relief valve (16, 17) to be relieved, wherein the PD controller (18) is performed with the target swing angle of PD control inputted by the sum of the swing braking angle predicted from the calculated inertia moment of the upper swing body (13) plus the swing angle detected of the upper swing body (13), so that the target swing angle can be reached by compensating the inertia moment of the upper swing body which varies as the work device is operated during the return swing of the upper swing body.

Referring to FIGS. 2 to 5, according to an embodiment of the present invention, a swing control method for construction equipment, including first and second hydraulic pumps (1, 2) and a pilot pump (3);

a work device including a boom, an arm and a bucket, which are operated by a boom cylinder (5), an arm cylinder (6) and a bucket cylinder (7), respectively, driven by the hydraulic fluid of the first and second hydraulic pumps (1, 2);

a work device control valve (8) which is configured to control hydraulic fluid supplied from the first and second hydraulic pumps (1, 2) to the boom cylinder (5), arm cylinder (6) and bucket cylinder (7), respectively;

a swing motor (9) for swinging an upper swing body (13) which is driven by the hydraulic fluid supplied from one of the first and second hydraulic pumps (1, 2);

a swing control valve (10) for controlling the hydraulic fluid supplied to the swing motor (9) from the first or second hydraulic pump (1, 2);

a swing operation lever (RCV) (11);

a direction control valve (14, 15) for applying to the swing control valve (10) a pilot pressure supplied by operating the swing operation lever (11), or a pilot pressure supplied by selecting a semiautomatic swing mode;

an electronic proportional pressure control valve (23, 24) for applying the hydraulic fluid from the pilot pump (3) to the swing control valve (10) through the direction control valve (14, 15), if the semiautomatic swing mode is selected during the return swing of the upper swing body (13);

an electronic proportional variable relief valve (16, 17) which variably controls a preset relief pressure so as to vary a braking torque of the swing motor (9);

a swing angle sensor (22) for detecting a swing angle of the upper swing body (13);

displacement sensors (19, 20, 21) for detecting the displacements of the boom, arm, and bucket, respectively, during a return swing of the upper swing body (13); and a controller (18) for applying an electric control signal and adjusting the preset relief pressure of the electronic proportional variable relief valve (16, 17) by the electric control signal during the return swing of the upper swing body, the method comprises;

a step of selecting the semiautomatic swing mode (S10);

a step of shifting the direction control valve (14, 15) so that the pilot pressure regulated by the electronic proportional pressure control valve (23, 24) is applied to the swing control valve (10), if the semiautomatic swing mode is selected during the return swing of the upper swing body (13) (S20);

a step of applying the pilot pressure to the swing control valve (10) so that the hydraulic fluid from the hydraulic pump (3) corresponds to a maximum operation amount of the swing operation lever (11) (S30);

a step of detecting the swing angle of the upper swing body (13) by the swing angle sensor (22) (S40);

a step of measuring the lengths of boom, arm and bucket by the displacement sensors (19, 20, 21) that are installed in the boom cylinder (5), arm cylinder (6) and bucket cylinder (7) (S50A);

a step of calculating the inertia moment of the upper swing body (13) from the angles of the boom, arm, and bucket that are detected by the displacement sensors (19, 20, 21) and outputted to the controller (18) (S50B);

a step of predicting a swing braking angle from the inertia moment of the upper swing body (13) which is calculated from the detected angles of the boom, arm, and bucket that are detected by the displacement sensors (19, 20, 21) and outputted to the controller (18) during the return swing of the upper swing body (13) (S50C);

a step of determining whether or not the sum of a predicted swing braking angle plus the swing angle detected of the upper swing body is equal to a target swing angle (S60);

a step of shifting to a neutral state by blocking the pilot pressure applied to the swing control valve (10), if the sum of the predicted swing braking angle plus the swing angle detected of the upper swing body (13) is equal to the target swing angle (S70);

a step of applying an electric control signal to the relief pressure of the electronic proportional variable relief valve (16, 17) so that the relief pressure of the electronic proportional variable relief valve (16, 17) is preset to increase or decrease in order to make the target swing angle controlled to be the sum of the swing braking angle predicted from the inertia moment of the upper swing body plus the swing angle of the upper swing body, if the work device is operated during the return swing of the upper swing body (13) (S80);

a step of determining whether the swing angle of the upper swing body reaches the target swing angle (S90); and a step of shifting the direction control valve (14, 15) so that the pilot pressure by operating the swing operation lever (11) is applied to the swing control valve (10), if the swing angle of the upper swing body (13) reaches the target swing angle (S100).

According to the aforementioned configuration, if the upper swing body (13) of the excavator is to be swung to return, the semiautomatic swing mode is selected by the selection switch installed in the operation lever (11), which is operated by the operator as in S10.

As in S20, if the semiautomatic swing mode is selected during the return swing of the upper swing body (10), the direction control valve (14, 15) is shifted upwards in the figure by the electric control signal applied from the controller (18).

Thus, the hydraulic fluid supplied from the pilot pump (3) can be applied to the swing control valve (10) through the electronic proportional pressure control valve (23, 24) and the direction control valve (14, 15).

As in S30, the pilot pressure introduced from the hydraulic pump (3) is applied to the swing control valve (10), which is converted by the electronic proportional pressure control valve (23) in response to the maximum operation amount of the swing operation lever (11). (For example, the spool of the swing control valve (10) is shifted to the right in the figure).

In other words, after an electrical current value inputted to the electronic proportional pressure control valve (23, 24) is converted to a pilot pressure which corresponds to the maximum operation amount of the swing operation lever (11), the converted pilot pressure (e.g. 40 bar) is applied to the swing control valve (10) through the direction control valve (14, 15).

As in S40, after the swing angle of the upper swing body (13) is detected by the swing angle sensor (22), the detected signal is outputted to the controller (18).

As in S50A, after the lengths of boom, arm and bucket are detected by the displacement sensors (19, 20, 21) that are installed in the boom cylinder (5), arm cylinder (6) and bucket cylinder (7), the detected signals are outputted to the controller (18).

As in S50B, the controller (18) calculates the inertia moment of the upper swing body (13) from the angles of the boom, arm, and bucket that are detected by the displacement sensors (19, 20, 21) and outputted to the controller (18).

As in S50C, the swing braking angle is predicted from the inertia moment of the upper swing body (13) which is calculated by the controller (18) when the work device is operated during the return swing of the upper swing body (13).

As in S60, it is determined whether or not the sum of the predicted swing braking angle plus the swing angle detected of the upper swing body (13) is equal to the target swing angle.

At this moment, if the sum of the predicted swing braking angle plus the swing angle of the upper swing body (13) is equal to the target swing angle, it proceeds to S70. If not, it proceeds to S30.

As in S70, if the sum of the predicted swing braking angle plus the swing angle detected of the upper swing body (13) is equal to the target swing angle, it shifts to the neutral state by blocking the pilot pressure applied to the swing control valve (10).

In other words, the pilot pressure (e.g. 0 bar) that is converted in response to the electric control signal inputted from the controller (18) to the electronic proportional pressure control valve (23, 24) is applied to the swing control valve (10) through the direction control valve (14, 15).

Accordingly, as the swing control valve (10) is put in a neutral state, the hydraulic fluid supplied from the second hydraulic pump (2) to the swing motor (9) is blocked.

As in S80, the electric control signal is applied so that the relief pressure of the electronic proportional variable relief valve (16, 17) to be relieved (e.g. the relief valve shown in the right in the figure) is preset to increase or decrease in order to make the target swing angle controlled to be the sum of the swing braking angle predicted from the inertia moment of the upper swing body plus the swing angle of the upper swing body, if the work device is operated during the return swing of the upper swing body (13).

The controller (18) further employs the PD (Proportional Derivative) controller for applying the calculated electrical current value to the electronic proportional variable relief valve (16, 17) to be relieved (e.g. the relief valve (17)), wherein the electrical current value is obtained by a predetermined PD control using the inputted target swing angle of the sum of the swing braking angle predicted from the calculated inertia moment of the upper swing body (13) plus the swing angle of the upper swing body (13).

The inertia moment, of the upper swing body (13) can be varied when the work device is operated during the return swing of the upper swing body.

At this moment, the inertia moment can be compensated to make the target swing angle reached by varying the swing braking torque of the swing motor (9) with the increase or decrease in the preset relief pressure of the electronic proportional variable relief valve (16, 17).

The PD controller can be used for the control of the braking torque in the semiautomatic swing control apparatus as it allows the target swing angle to be traced at the fast response without the application of the complex equation of motion.

As in S90, it is determined whether or not the actual swing angle of the upper swing body (13) reaches the target swing angle which is sum of the predicted swing braking angle plus the swing angle of the upper swing body. If the swing angle reaches the target angle, it proceeds to S100.

If not, it proceeds to S80 in which the electrical signal is applied so that the relief pressure of the electronic proportional variable relief valve (16, 17) in its exit side is preset to increase or decrease.

As in S100, the direction control valve (14, 15) is shifted by the electrical signal applied from the controller (18) (spool shift as shown in FIG. 2), if the swing angle of the upper swing body (13) reaches the target swing angle.

That is, as the direction control valve (14, 15) is shifted to the initial position due to the spring force of the valve spring, the pilot pressure by the swing operation lever (11) is applied to the swing control valve (10) through the direction control valve (14, 15).

Although the present invention has been described with reference to the preferred embodiment in the attached figures, it is to be understood that various equivalent modifications and variations of the embodiments can be made by a person having an ordinary skill in the art without departing from the spirit and scope of the present invention as recited in the claims.

According to the present invention having the above-described configuration, even if the inertia moment of the upper swing body is varied when the work device is operated during the return swing in case of loading operation of excavator or conveying operation, the target swing angle can be reached by controlling the braking torque of the swing motor.

What is claimed is:

1. A swing control apparatus for construction equipment comprising;

first and second hydraulic pumps and a pilot pump;

a work device including a boom, an arm and a bucket, which are operated by a boom cylinder, an arm cylinder and a bucket cylinder, respectively, driven by hydraulic fluid of the first and second hydraulic pumps;

a work device control valve which is configured to control hydraulic fluid supplied from the first and second hydraulic pumps to the boom cylinder, arm cylinder and bucket cylinder, respectively;

a swing motor for swinging an upper swing body which is driven by hydraulic fluid supplied from one of the first and second hydraulic pumps;

a swing control valve for controlling the hydraulic fluid supplied to the swing motor from the first or second hydraulic pump;

a swing operation lever;

a direction control valve for applying to the swing control valve a pilot pressure supplied by operating the swing operation lever, or a pilot pressure supplied by selecting a semiautomatic swing mode;

at least one electronic proportional variable relief valve installed in the swing motor, which variably controls a preset relief pressure so as to vary a braking torque of the swing motor; and a controller for applying an electric control signal to the electronic proportional variable relief valve to be relieved so that the relief pressure of the electronic proportional variable relief valve is preset to increase or decrease in order to make a target swing angle become the sum of a swing braking angle predicted from the inertia moment of the upper swing body plus a swing angle detected of the upper swing body, when the semiautomatic mode is selected and the work device is operated during a return swing of the upper swing body;

wherein the controller includes a PD controller for applying a calculated electrical current value to the electronic proportional variable relief valve to be relieved, in which the PD controller is performed with the target swing angle of PD control inputted by the sum of the swing braking angle predicted from the inertia moment of the upper swing body plus the swing angle detected of the upper swing body so that the target swing angle can be reached by compensating the inertia moment of the upper swing body, which varies when the work device is operated during the return swing of the upper swing body.

2. The swing control apparatus of claim 1, further comprising an electronic proportional pressure control valve which is configured to apply a pilot pressure to the swing control valve, wherein the pilot pressure from the pilot pump is adjusted by converting an electrical current value that corresponds a maximum operation amount of the swing operation lever, if the semiautomatic swing mode is selected.

3. The swing control apparatus of claim 1, wherein the swing operation lever includes a selection switch to select the semiautomatic swing mode, so that the semiautomatic swing mode turns off if the swing operation lever is operated during the return swing of the upper swing body.

4. The swing control apparatus of claim 1, further comprising;

displacement sensors for detecting the displacements of the boom, arm and bucket to calculate respective angles of the boom, arm and bucket during the return swing of the upper swing body and outputting the detected respective angle signals to the controller; and a swing angle sensor for detecting a swing angle of the upper swing body and outputting the detected swing angle signal to the controller.

* * * * *